US005509290A

United States Patent [19]

Faivre

[11] Patent Number: 5,509,290

[45] Date of Patent: Apr. 23, 1996

[54] TOOLS FOR COLD FLOW FORMING OF ASSEMBLY POINTS IN SHEET METAL

[76] Inventor: Jean-Claude Faivre, Rue du Locle 44, CH-2300 La Chaux-de-Fonds, Switzerland

[21] Appl. No.: 362,539

[22] PCT Filed: Apr. 29, 1994

[86] PCT No.: PCT/EP94/01445

§ 371 Date: Apr. 7, 1995

§ 102(e) Date: Apr. 7, 1995

[87] PCT Pub. No.: WO94/25196

PCT Pub. Date: Nov. 10, 1994

[30] Foreign Application Priority Data

May 4, 1993 [FR] France ..... 93 05297

[51] Int. Cl.[6] ..... B21D 41/00

[52] U.S. Cl. ..... 72/375; 29/21.1; 29/798; 72/465

[58] Field of Search ..... 72/465, 395; 29/21.1, 29/243.53, 283, 432, 521, 798

[56] References Cited

U.S. PATENT DOCUMENTS

| | | | |
|---|---|---|---|
| 2,924,312 | 2/1960 | Williams | 29/21.1 |
| 4,208,776 | 6/1980 | Schleicher | 29/798 |
| 4,660,403 | 4/1987 | Slasinski | 29/432 |
| 4,757,609 | 6/1988 | Sawdon | 29/798 |
| 4,825,525 | 5/1989 | Obrecht et al. | 29/21.1 |
| 5,131,258 | 7/1992 | Kynl | 72/395 |
| 5,207,086 | 5/1993 | Kynl | 72/465 |
| 5,208,974 | 5/1993 | Sawdon et al. | 29/798 |
| 5,230,136 | 7/1993 | Cronn et al. | 29/798 |

*Primary Examiner*—Daniel C. Crane
*Assistant Examiner*—Ed Tolan
*Attorney, Agent, or Firm*—Mark P. Stone

[57] ABSTRACT

Improvements relating to tools for cold flow forming of assembly points in sheet metal. The tools comprise first tool (1) with a punch (6) and a blank holder (5) and a second tool (10) with a guiding surface (16) from which extends a finger (14) terminated by an anvil (15), a die (20) formed by at least two shells (18), each of said shells (18) having a shoulder (21) slidingly mounted on the guiding surface (16) and in contact with the lateral surface of the finger (14) through resilient means (26), the guiding means of the sections (18) being provided together with a stop restricting the separation of the shells (18) during cold flow. The improvements are characterized in that the stop consists of two half sections (30) elastically secured to the second tool (10).

14 Claims, 3 Drawing Sheets

Figure 2:
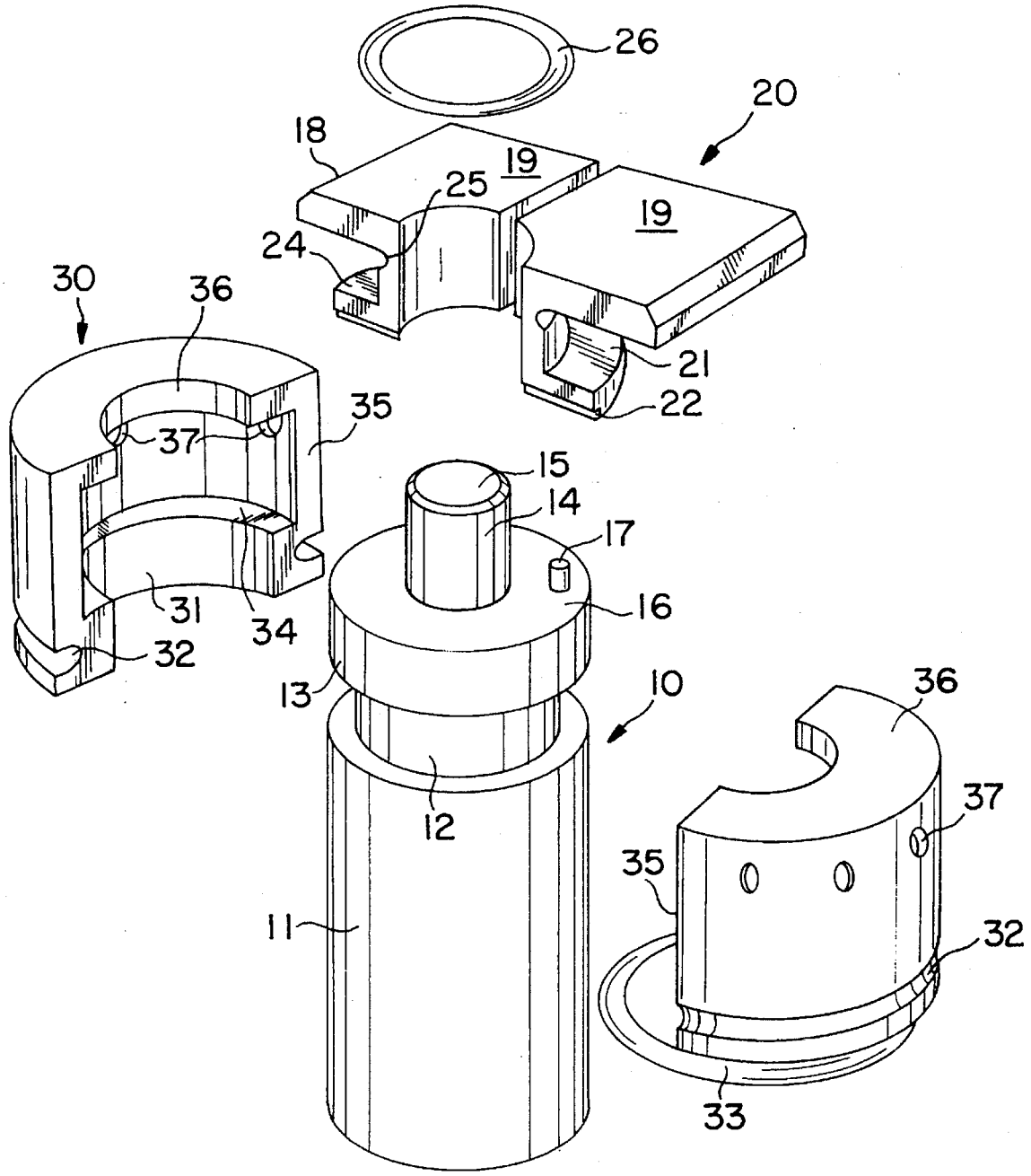

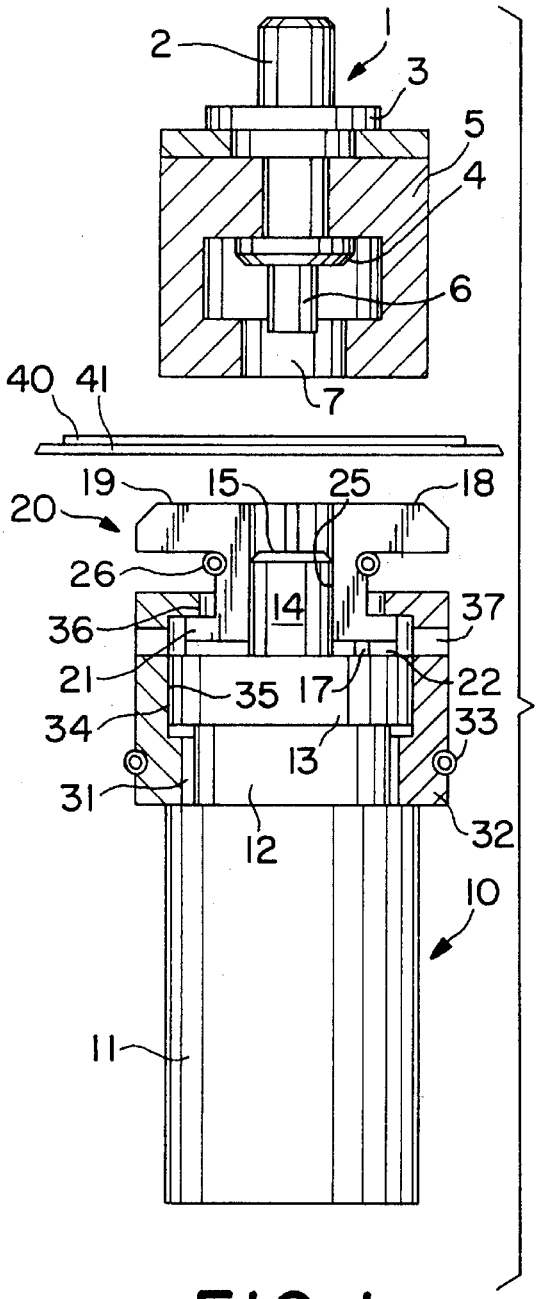
FIG. 1
FIG. 4
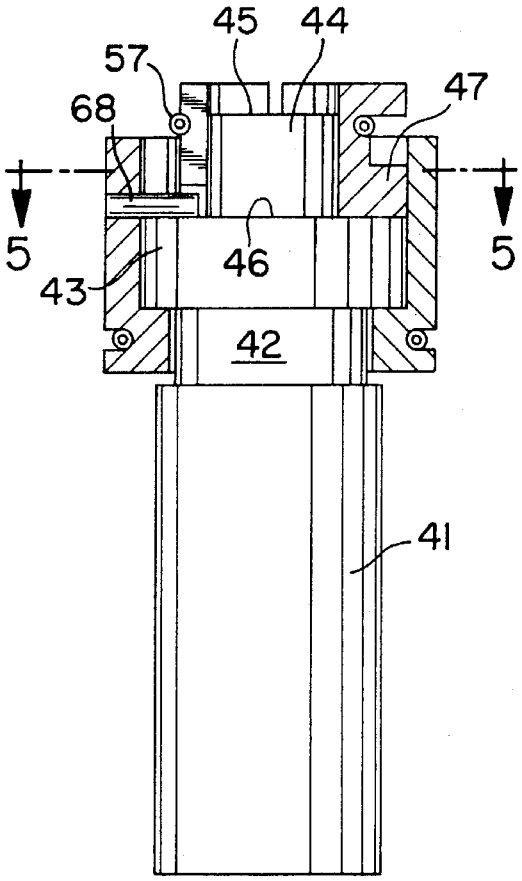
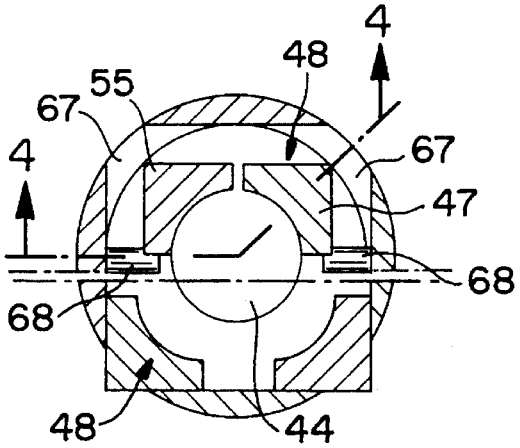
FIG. 5

TOOLS FOR COLD FLOW FORMING OF ASSEMBLY POINTS IN SHEET METAL

This application is a 35 U.S.C. 371 of PCT/EP94/01445 dated Apr. 29, 1994.

The present invention refers to a tool for making joints between sheet-formed members, metal or non-metal.

The invention concerns more precisely a tool which can be used in a joining operation carried out on at least two sheet-formed members, for instance metal sheets. By means of a co-operating punch and matrix the members are joined together by drawing the material forming a cavity in the sheets and laterally extending the bottom part of said cavity to lock the members to each other. The tool according to the invention could also be used in a joining operation in which the members are joined together by lancing and forming a part of one member through an unblanked part of the other member and thereafter staking the lanced and formed part of the one member to an adjacent surface of the other member to secure the members together in overlaying relation.

It is known from the prior art tools in which the matrix comprises at least two matrix-parts which at one end-portion co-operates with an anvil and at the other end-portion are arranged sliding on a support surface against the forces from an elastic member. A stop means is arranged to limit the lateral moment of the matrix-parts. The elastic members are generally constituted by a ring made of an elastomer surrounding the matrix-parts.

Such an arrangement has a certain numbers of disadvantages. Due to the considerable forces between the two tool-parts, i.e. punch and matrix, and the metal sheets during the forming of the joint small pieces of metal might be separated from the sheet material which pieces are difficult to evacuate from the tool in which they might block the movement of the matrix-parts or otherwise disturb the proper function of the tool.

Additionally the stop means is in general comprising a solid ring formed member fixed to the second part of the tool, i.e. the matrix. This arrangement has several disadvantages. If for example the lateral displacement of the matrix-parts exceeds what has been initially envisaged these tool-parts risk to be damaged in the contact with the stop means.

Finally the assembly and disassembling of the matrix is complicated and time consuming.

One of the objects of the present invention is to avoid these inconveniences.

The invention concerns a tool for carrying out joints between sheet material, comprising a first tool-part with a punch and a side pressing element and a second tool-part provided with a support surface from which an anvil erects. A matrix comprising at least two matrix-parts is arranged around said anvil, each matrix-part comprising a heel arranged sliding against said support surface and being applied against the lateral surface of said anvil by means of elastic means. Means for guiding the matrix-parts during the sliding movement are provided as well as a stop means limiting the lateral displacement of the matrix-parts. The tool is characterised in that the stop means comprises at least two shell-formed parts fixed elastically on said second tool-part.

According to another characteristic the lateral wall of each matrix-part is provided with a waist and the shell-formed parts are terminated on the inside by a flange cooperating with the edge of the waist close to the heel, the flange and the edge constituting guiding means for the matrix-parts.

According to a further characteristic the elastic means which applies the matrix-parts against the lateral surface of the anvil is constituted by an elastic ring arranged at the bottom of the waist of the matrix-parts.

Means for preventing the rotation of the matrix-parts are preferably also arranged.

The heel of at least one of the matrix-parts is provided on a surface turned in the direction of an adjacent matrix-part with a notch and the support surface is provided with a pin co-operating with said notch.

Each shell-formed part is preferably provided with openings at a level corresponding to the support surface.

According to a special embodiment each shell-formed part comprises means co-operating with arrangement of the second tool-part for preventing rotational movement of said shell-formed parts in relation to said second tool-part.

The fixed portion of the second tool-part could be provided with lateral flat surfaces and each shell-formed part could at its lateral inner surface be provided with means arranged to co-operate with said flat surfaces to prevent said rotational movement.

According to another embodiment each shell-formed part is provided with a pin on its inner surface arranged to cooperate with a notch in the heel of the matrix-parts.

Finally there could be four matrix-parts provided and each heel could be formed with a 90° corner. Each of said corners could be arranged to slide during the movement of the matrix-parts into corresponding openings in the shell-formed parts.

Figure 3:
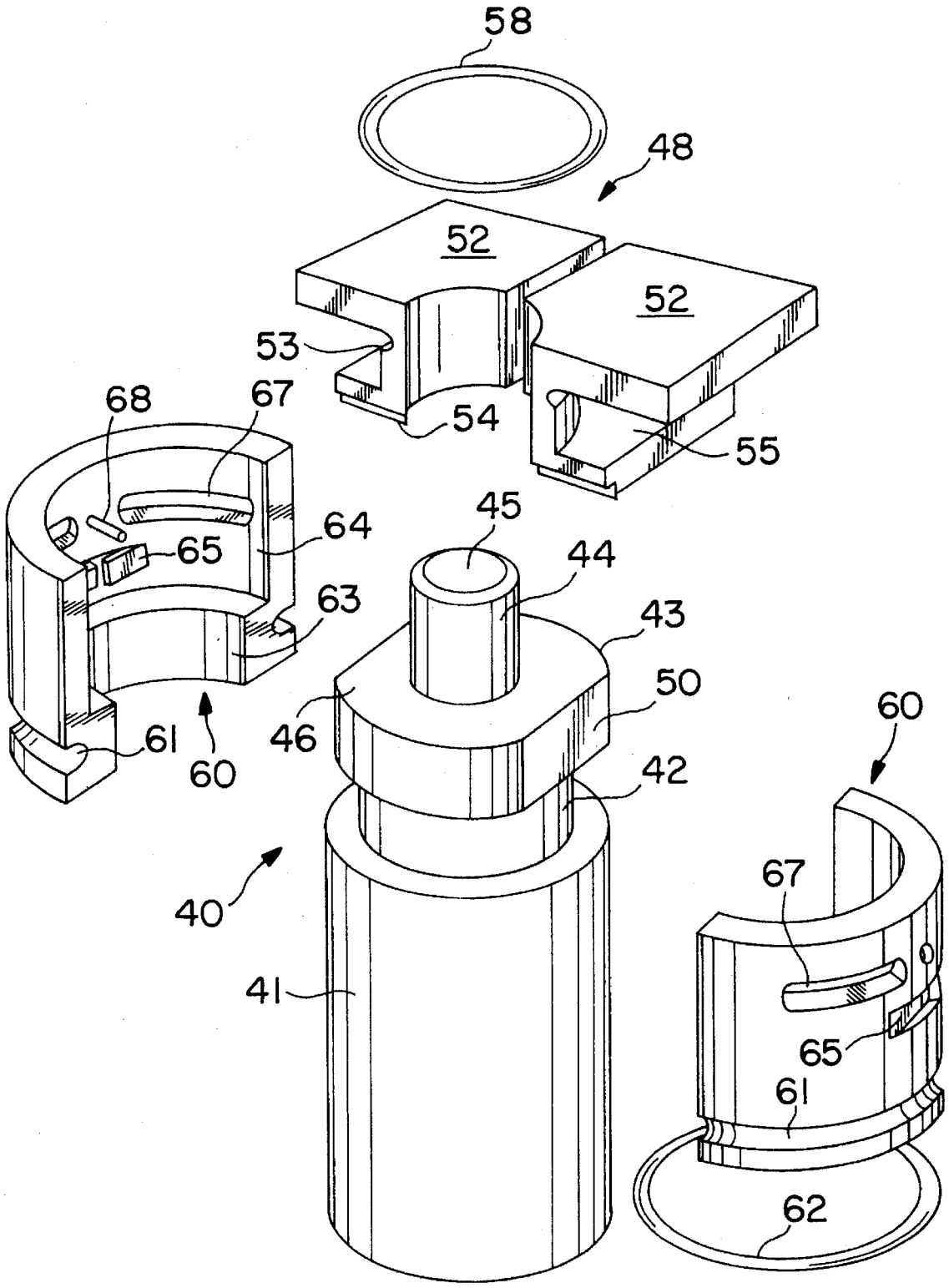

The invention will now be described more in detail with reference to particular embodiments, given as examples, and described in the enclosed drawings in which:

FIG. 1 is a schematic view in section showing a punch and a matrix according to the invention, FIG. 2 is an exploded perspective view showing one embodiment of the invention, FIG. 3 is an exploded perspective view of another embodiment according to the invention, FIG. 4 is a sectional view along the line 4—4 in FIG. 5, FIG. 5 is a sectional view along the line 5—5 in FIG. 4.

In FIG. 1 is shown a first tool-part 1 having a shaft 2 arranged to be fixed on a moving part and having a shoulder 3 and a flange 4 between which the side pressing element 5, made of an elastic material, is arranged provided with a hole 7 through which the punch may protrude during the operation.

The first tool-part 1 is arranged to co-operate with a second tool-part 10 comprising a body 11 with a waist 12 followed in the longitudinal direction by a ring 13 from the centre of which the anvil 15 erects.

On the side from which the anvil erects the ring 13 is flat and presents a support surface 16, on which at least one pin 17 protrudes.

The matrix 20 is in this example constituted by four matrix-parts 18 which at one end-portion have a large support surface 19 for the sheet members and at the other end-portion are provided with a heel 21 arranged to co-operate with the support surface 16, each heel 21 having at one of its edges arranged to be turned towards a corresponding edge of an adjacent matrix-part a notch 22 the depth of which corresponds to the length of the protruding pin 17.

Between the heel and the support surface 19 a large waist 24 is arranged having a groove 25 arranged to receive a resilient means 26 in the form of a ring.

On the body 11 is mounted a stop means constituted in this example by two shell-formed parts 30 each having at its end-portions and on the inner side a flange 31, 36 arranged to co-operate with the waist 12 and 24 respectively. In the mounted position the stop means will limit the vertical movement of the matrix parts.

Opposite to the flange 31 on the external surface of the shell-formed parts 30 a groove 32 is arranged in the parts to receive a resilient means in the form of a ring 33 which ring will keep the shell-formed parts in position.

The lateral side walls of the shell-formed parts 30 close to the guiding surface 16 are provided with openings 37 permitting the removal of the small metal parts mentioned above for instance by means of a jet of compressed air.

When making a joint between two metal sheets 40 and 41, the tool-part 1 is lowered in such a way that the sheets are blocked between the side pressing element 5 and the support surface 19 on the matrix. It should be noticed that the upper part of the matrix has a relatively large surface which is an advantage especially with sheets of aluminum to avoid marks on said sheets. The punch 6 is then activated which means that it is approaching and then entering into the sheet members 40, 41 on its way downwards in the direction of the matrix 20 drawing the sheet material and forming a cavity in the two sheet members 40 and 41. The matrix-parts 18 forming the matrix 20 are held together by means of the resilient means 26 when the sheet members 40 and 41 at the bottom of the cavity are pressed between the anvil 15 and the punch 6. Due to the resilient means 26 the matrix-parts 18 can now elastically move laterally as the bottom part of the cavity expands radially due to the floating effect. This lateral movement of the material in the sheet members is forming the mushroom-shaped joint between the sheets.

The pin 17 is co-operating with a notch 22 thereby avoiding rotation of the matrix. It should be noted that a space is arranged between the flanges 36 and the bottom of the waist 24 as well as between the lateral external edge of the heels 21 and the lateral internal wall of the shell-formed parts 30. This space is necessary to allow the movement of the matrix-parts 18 during the realisation of the joint. However, if for any reason whatsoever the distance of the lateral movement should increase, the shell-formed parts 30 could elastically move laterally thereby avoiding a risk of damage for the matrix-parts.

The FIGS. 3, 4 and 5 show an embodiment especially designed to be used for making joints between sheet members having a larger thickness. In this case the travelled distance of the matrix-parts is considerable and usually a bulky stop arrangement has to be used. The present embodiment makes is possible to avoid this disadvantage.

In FIG. 3 an exploded perspective view shows a second tool-part having the general designation 40. This tool-part is of course combined with a first tool-part 1 of the type already described, not shown in the FIGS. 3, 4 and 5.

The second tool-part 40 comprises a body 41 having a waist 42 followed in the longitudinal direction by a ring 43 of larger diameter at the centre of which an anvil 45 erects. The surface of the ring 43 on the same side as the anvil 45 constitutes a support surface 46 for the heels 47 of the matrix-parts 48.

The ring 43 comprises two flat portions 50, 180° from each other in the rotational direction.

In this embodiment four matrix-parts 48 are provided each having a large support surface 52 at the end-portion opposite to the heel 47. Between these two parts there is arranged a waist 53 and each heel 47 has a notch 52.

In the rest position on the support surface the outer edge of the four heels 47 form together a square and each heel has a corner 55.

In the waist 53 a ring-formed resilient means 57 is arranged to keep the matrix-parts 48 together.

On the body 41 is mounted a stop means comprising two shell-formed parts which comprise in the vicinity of one of the end-portions, on the external surface, a groove 61 in which is inserted a ring-formed resilient means 62 keeping the two parts together.

Opposite to the groove 61, on the inner surface of the shell-formed parts 60, a flange 63 is arranged which reaches into the waist 42. On the inner lateral surface 64 of each shell-formed part 60 means 65 are arranged to bear against the flat surfaces 50 so that the shell-formed parts 60 could not rotate in relation to the body 41.

Each shell-formed part 60 has two openings 67 and between these openings a pin 68.

As can be seen in FIGS. 4 and 5 the pins 68 reach into the notches 54 thus preventing the rotation of the matrix in relation to the body 41.

When a joint is carried out the heels 47 of the matrix-parts 48 slide on the surface 46 against the force from the resilient means 58 and the corners 55 reach through the openings 67 at the end of the movement.

This arrangement allows relatively large movement for the matrix-parts 48 with relatively small shell-formed parts 60.

The invention is of course not limited to the embodiments described above. A number of modifications could be applied without leaving the scope of protection of the invention.

I claim:

1. Tool for forming joints between sheet material, said tool comprising a first tool-part (1) with a punch (6) and a side pressing element (5) for engaging one side of the sheet material, a second tool-part (10) cooperable with the first tool part and provided with a support surface (16) from which an anvil (15) extends, a matrix (20) comprising at least two matrix-parts (18) for engaging the other side of the sheet material and being arranged around said anvil (15) and laterally displaceable relative to said anvil, each matrix-part (18) comprising a heel (21) arranged for sliding against said support surface (16) and being applied against a lateral surface of said anvil (15) by means of elastic means (26), means for guiding the matrix-parts (18) during sliding movement and a stop means limiting the lateral displacement of the matrix-parts (18) characterized in that the stop means comprises at least two shell-formed parts (30) fixed elastically on said second tool-part (10).

2. Tool according to claim 1, characterised in that a lateral wall of each matrix-part (18) is provided with a waist (24) and the shell-formed parts (30) are terminated on an inside by a flange (36) co-operating with an edge of the waist close to the heel, the flange and the edge constituting guiding means for the matrix-parts.

3. Tool according to claim 2, characterised in that the elastic means which applies the matrix-parts (18) against the lateral surface of the anvil (15) is constituted by an elastic ring (26) arranged at a bottom of the waist (24) of the matrix-parts.

4. Tool according to claim 1, characterised in that means (17) for preventing rotation of the matrix-parts (18) in relation to said second tool-part (10) are provided.

5. Tool according to claim 4, characterized in that the heel (21) of at least one of the matrix-parts (18) is provided with a notch (22) facing in a direction towards an adjacent one of said matrix-parts (18) and that the support surface (16) is provided with a pin cooperating with said notch.

6. Tool according to claim 1, characterised in that each shell-formed part (30) is provided with openings (37) at a level corresponding to the support surface.

7. Tool according to claim 1, characterised in that each shell-formed part (60) comprises means (65) co-operating with an arrangement (50) of the second tool-part (40) for preventing rotational movement of said shell-formed parts (60) in relation to said second tool-part (40).

8. Tool according to claim 7, characterised in that the second tool-part (40) is provided with lateral flat surfaces (50) and that each shell-formed part at its lateral inner surface is provided with elastic means (65) arranged to co-operate with said flat surfaces to prevent said rotational movement.

9. Tool according to claim 1, characterised in that each shell-formed part (60) is provided with a pin (68) on its inner surface arranged to co-operate with a notch (54) in the heel (47) of the matrix-parts (48).

10. Tool according to claim 1, characterised in that the number of matrix-parts (48) is four, each heel is formed with a 90° corner and each of said corners is arranged to slide, during the movement of the matrix-parts (48), into corresponding openings (67) in the shell-formed parts (60).

11. Tool according to claim 4, characterised in that each shell-formed part (60) is provided with a pin (68) on its inner surface arranged to co-operate with a notch (54) in the heel (47) of the matrix-parts (48).

12. Tool according to claim 7, characterised in that each shell-formed part (60) is provided with a pin (68) on its inner surface arranged to co-operate with a notch (54) in the heel (47) of the matrix-parts (48).

13. Tool according to claim 1 further including cooperating means on said matrix and on said stop means for limiting longitudinal movement of said matrix-parts relative to said anvil.

14. Tool according to claim 13 wherein said cooperating means includes at least one flange on each of said matrix-parts and a waist portion on each of said shell-formed parts.

* * * * *